US009934766B2

(12) United States Patent
Murray et al.

(10) Patent No.: US 9,934,766 B2
(45) Date of Patent: Apr. 3, 2018

(54) SNARE DRUM HAVING IMPROVED THROW OFF MECHANISM

(71) Applicant: BD Performing Arts, Concord, CA (US)

(72) Inventors: Allan Murray, Concord, CA (US); Scott Johnson, Concord, CA (US)

( * ) Notice: Subject to any disclaimer, the term of this patent is extended or adjusted under 35 U.S.C. 154(b) by 0 days.

(21) Appl. No.: 15/413,326

(22) Filed: Jan. 23, 2017

(65) Prior Publication Data

US 2017/0213529 A1 Jul. 27, 2017

Related U.S. Application Data

(60) Provisional application No. 62/281,667, filed on Jan. 21, 2016.

(51) Int. Cl.
*G10D 13/02* (2006.01)

(52) U.S. Cl.
CPC ..... *G10D 13/025* (2013.01)

(58) Field of Classification Search
CPC ..... G10D 13/025
USPC ..... 84/415
See application file for complete search history.

(56) References Cited

U.S. PATENT DOCUMENTS 1,794,969 A * 3/1931 Logan ..... G10D 13/025 84/415
2,274,435 A * 2/1942 Slingerland ..... G10D 13/025 84/415
2,495,896 A * 1/1950 Jeffries ..... G10D 13/025 84/417
2,604,001 A * 7/1952 Lewan ..... G10D 13/025 84/417
3,113,481 A * 12/1963 Thompson ..... G10D 13/025 84/415
3,981,220 A * 9/1976 Clark ..... G10D 13/021 84/415
4,018,130 A * 4/1977 Gariepy, Sr. ..... G10D 13/025 84/415
4,138,920 A * 2/1979 Meador ..... G10D 13/025 84/415

(Continued)

OTHER PUBLICATIONS

International Search Report and Written Opinion in corresponding International Application No. PCT/US2017/014633. (dated May 24, 2017).

*Primary Examiner* — David Warren
*Assistant Examiner* — Christina Schreiber
(74) *Attorney, Agent, or Firm* — Brian Beverly; Beeson Skinner Beverly, LLP

(57) ABSTRACT

A snare drum having an improved throw off includes a strainer shaft and a strainer bar both extending through the interior of the drum shell. The strainer bar is linked to the strainer shaft, a snare assembly is connected to the strainer bar, and a handle rotates the strainer shaft which moves the strainer bar and snare assembly between an upper position in which the snares of the snare assembly are engaged with the bottom head of the drum, and lower position in which the snares are disengaged from the bottom head. The snares are in parallel relation to the bottom head of the drum throughout the range of movement between the upper and lower positions. In one embodiment, the drum comprises a wood laminate and the top and bottom shell caps comprise carbon fiber.

22 Claims, 12 Drawing Sheets

(56) References Cited

U.S. PATENT DOCUMENTS 4,339,982 A * 7/1982 Hoshino ..... G10D 13/025 84/415
4,787,286 A * 11/1988 Okumura ..... G10D 13/025 84/417
5,557,053 A * 9/1996 Nickel ..... G10D 13/025 84/415
5,844,157 A * 12/1998 Kasha ..... G10D 13/025 84/411 R
6,020,547 A * 2/2000 Chen ..... G10D 13/025 84/411 R
6,091,010 A * 7/2000 Gauger ..... G10D 13/025 84/415
6,441,287 B1 * 8/2002 Crouch ..... G10D 13/025 84/415
6,689,944 B1 * 2/2004 Okumura ..... G10D 13/025 84/411 R
6,846,978 B2 * 1/2005 Dorfman ..... G10D 13/025 84/411 R
7,223,910 B2 * 5/2007 Shimada ..... G10D 13/025 84/415
7,439,433 B1 * 10/2008 Hsieh ..... G10D 13/025 84/411 R
7,741,550 B2 * 6/2010 Miyajima ..... G10D 13/025 84/415
7,888,575 B1 * 2/2011 Toscano ..... G10D 13/023 84/413
8,143,507 B2 * 3/2012 Good ..... G10D 13/025 84/413
9,406,286 B1 * 8/2016 Simonek ..... G10D 13/025
2004/0168563 A1 * 9/2004 Dorfman ..... G10D 13/025 84/415
2006/0266198 A1 * 11/2006 Jeffries ..... G10D 13/025 84/417
2009/0133564 A1 * 5/2009 Miyajima ..... G10D 13/025 84/415
2009/0266221 A1 * 10/2009 Cleland ..... G10D 13/025 84/417
2011/0023686 A1 * 2/2011 Nakata ..... G10D 13/025 84/415
2015/0317962 A1 * 11/2015 Mihos ..... G10D 13/025 84/417
2016/0140939 A1 * 5/2016 Momose ..... G10D 13/025 84/415
2016/0307549 A1 * 10/2016 Lowery ..... G10D 13/025
2017/0213529 A1 * 7/2017 Murray ..... G10D 13/025

* cited by examiner

SNARE DRUM HAVING IMPROVED THROW OFF MECHANISM

CROSS-REFERENCE TO RELATED APPLICATIONS

This application claims the benefit of U.S. Provisional Application No. 62/281,648, filed Jan. 21, 2016, which is incorporated by reference herein.

BACKGROUND

Field of the Invention

This invention relates to musical instruments in generally and particularly to the throw off mechanisms of snare drums, an improved snare assembly, and shell caps that allow the shell of the drum to be larger than the drum heads.

Discussion of the Prior Art

The snares of snare drums are conventionally mounting to the drum using a pivoting throw off mechanism in which one end of the snare frame is pivotally attached to a first shaft fixed to one side of the bottom of the shell and the other end of the snare frame is hooked or latched to a second shaft fixed to the opposite side of the bottom of the shell. The snares can be moved from an upper position in which the snares are in contact with the bottom head of the drum to a lowered position by rotating the snare frame pivotally about the first shaft by lowering the second shaft.

One disadvantage to the pivoting throw off mechanism is that it is difficult to properly tune the snares. Tuning the snares using a pivoting throw off mechanism requires that the snare frame first be disengaged from the bottom head. One or more tuning aides must then be inserted between the snares and the bottom head and the snare frame returned to the engaged position but with the snares sufficiently separated from the bottom head by the tuning aides to be tuned. Small dowels or even pencils are commonly employed for this purpose. Once the snares have been tuned, the snare frame must be disengaged from the head, the tuning aides removed, and the snares reengaged with the bottom head by returning the snare frame again to the engaged position. Unfortunately, once reengaged, the snares may no longer be in tune because they were tuned in a stretched condition due to the insertion of the tuning aides. Removal of the tuning aides prior to reengagement of the snares to the bottom head causes the snares to lose tension and fall out of tune. Thus, a pattern of disengagement, inserting of tuning aides, reengagement, tuning, disengagement, removal of the tuning aides with lose of tension, and reengagement sets up, making it difficult and time-consuming to fine tune the snares.

SUMMARY OF THE INVENTION

A snare drum having an improved throw off includes a strainer shaft extending through the interior of and rotatably mounted to the drum shell. A handle is disposed on the outside of the shell and connected to the strainer shaft enabling rotation thereof. A strainer bar also extends through the interior of the drum shell and is connected to the strainer shaft with a linkage comprising primary and secondary links such that rotation of the handle moves the strainer bar vertically while constantly maintaining a parallel orientation to the strainer shaft.

A snare assembly is connected to the strainer bar and moves vertically in tandem therewith. Manipulation of the handle between an upper locking position and a lower disengagement position moves the strainer bar and snare assembly between an engaged configuration in which the snares of the snare assembly are engaged with the bottom head of the drum, and disengaged position in which the snares are lowered and disengaged from the bottom head.

The snare assembly is connected parallel the strainer bar so that the snares are maintained in parallel relation to the bottom head of the drum throughout the range of movement between the engaged and disengaged configurations.

The snare assembly includes parallel rails disposed perpendicularly to the bottom head of the snare drum. A having a plurality of apertures extends between and interconnects the rails. The rails and bottom plate form a chamber for amplification and direction of sounds emitted by the snare wires through the apertures of the bottom plate.

DETAILED DESCRIPTION OF THE ILLUSTRATED EMBODIMENT

Figure 1:
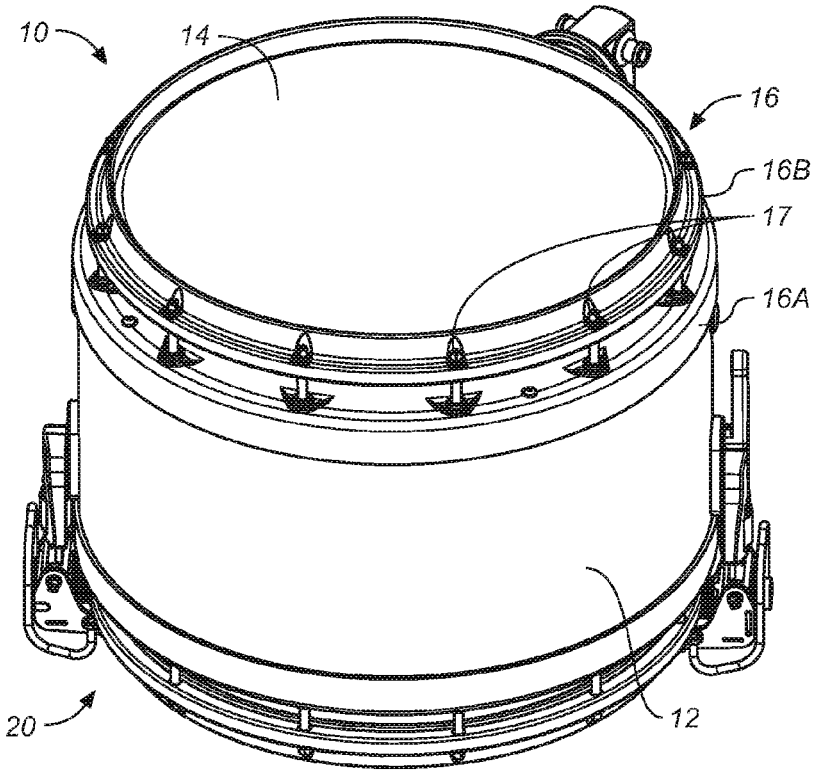
FIG. 1 is an upper perspective view of a snare drum according to the invention.
Figure 2:
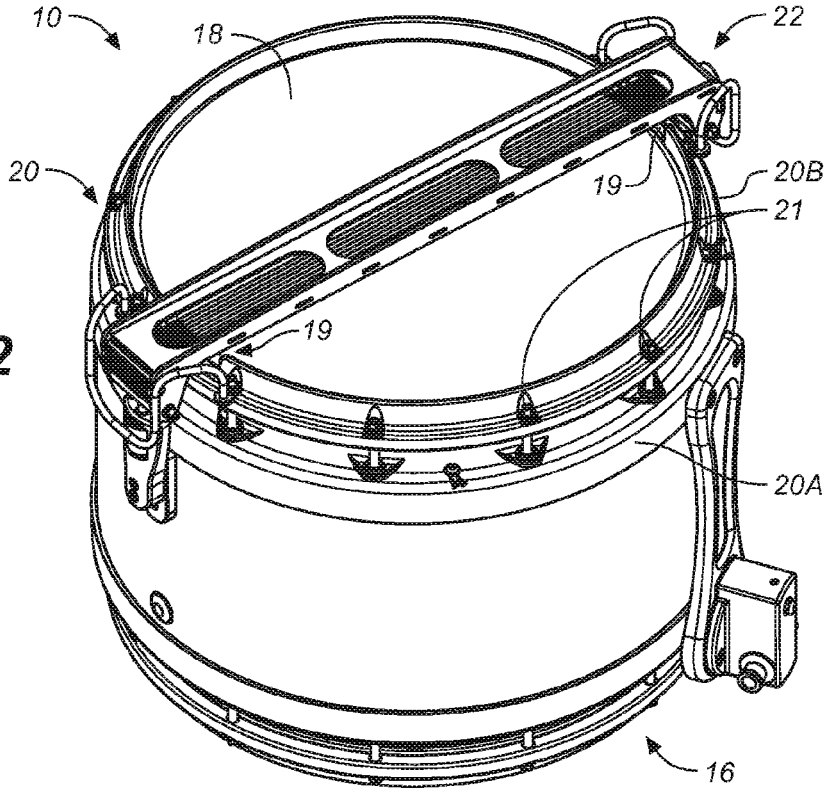
FIG. 2 is a lower perspective view thereof showing the snare assembly.

A snare drum according to the invention is referred to generally at numeral 10 in FIGS. 1 and 2. The snare drum 10 comprises a shell 12 and top head 14 held onto the shell by a top rim assembly 16. As seen in FIG. 2, the snare drum 10 also comprises a bottom head 18 held to the shell by a bottom rim assembly 20. FIGS. 2 and 3 show a snare assembly 22 attached to the bottom portion of the drum.

The top rim assembly 16 comprises a carbon-fiber shell cap 16A attached to the top of shell 12. In one embodiment of the snare drum the shell is constructed of laminated wood, particularly a 4 ply wood composite. Top head 14 is placed over the top edge of top shell cap 16A and is held thereon by top rim or hoop 16B. Top rim 16B is secured to top shell cap 16A with a plurality of tension rods 17. Similarly, the bottom rim assembly 20 comprises a carbon-fiber shell cap 20A attached to shell 12. Bottom head 18 is placed over the bottom edge of bottom shell cap 20A and is held thereon by bottom rim or hoop 20B. Bottom rim 20B is secured to bottom shell cap 20A with a plurality of tension rods 21 anchored in retention plates 23. Indents 19 on opposite sides of bottom hoop 20B accommodate snare assembly 22 so that the snares can engage bottom head 18 as discussed in greater detail below.

Figure 4A:
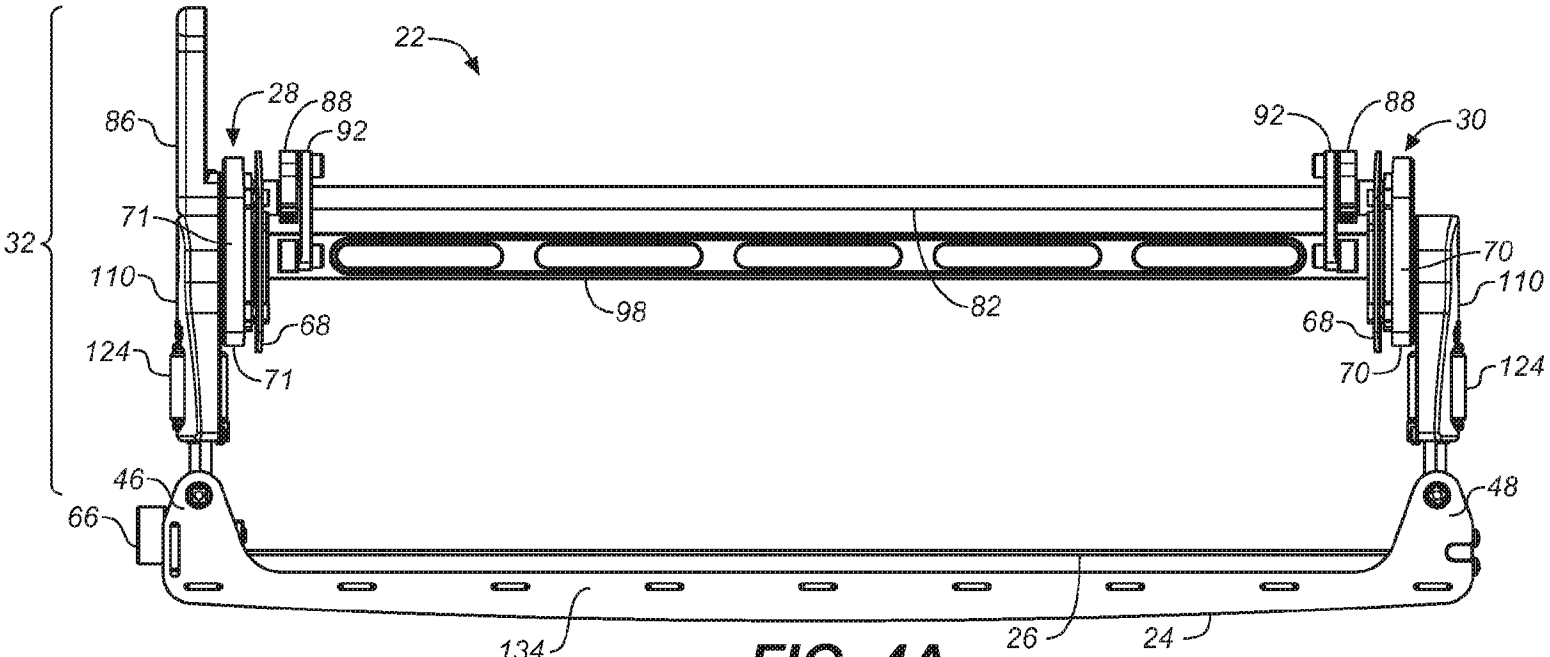
FIGS. 4A and 4B are side elevation and top plan views, respectively, of the throw-off mechanism, mounting assemblies, snare frame and snares thereof.
Figure 4B:
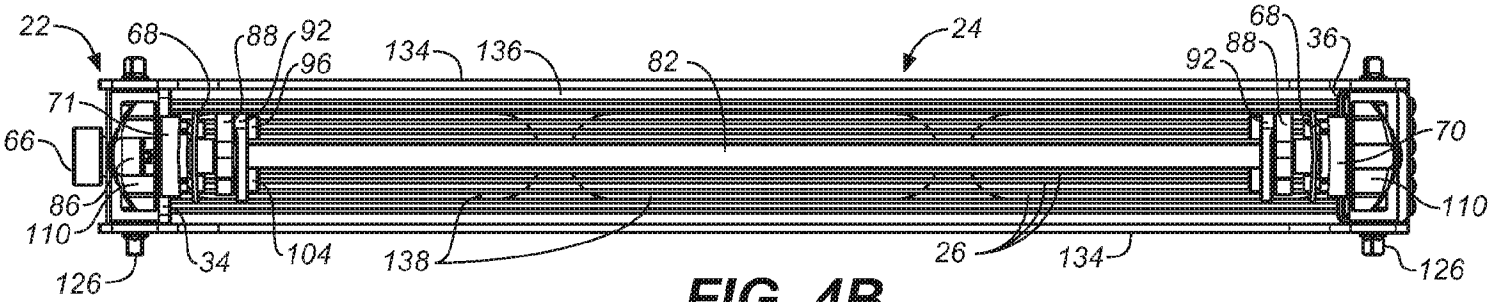

Referring next to FIGS. 4A and 4B, it can be seen that the snare assembly 22 includes a snare frame 24, snares 26, first and second opposed mounting assemblies 28, 30, and a throw-off mechanism 32. With additional reference to FIG. 5, it is seen that the snares 26 are suspended between retention block 34 and retention frame 36 on opposite ends of the frame. The first end 38 of each snare 26 is attached to retention block 34, and the second end 40 thereof is attached to retention frame 36.

On a first end 42 of the snare frame 24 a retention plate 44 extends between a pair of upwardly extending flanges 46. A pair of spaced apart upstanding mounting ears 48 is provided on the second end 50 of the snare frame.

The second ends 40 of the snare wires 26 are each secured to individual adjustment blocks 52 disposed on the inside wall 54 of retention frame 36. Adjustment screws 56 are inserted through the outside wall 58 of retention frame 36 and threadedly engage adjustment blocks 52, such that tightening or loosening adjustment screws 56 increases or decreases tension on individual snares 26.

Opposing retention stops 60 extending outwardly from each of the side walls 62 of retention frame 36 are sized to slide snugly into retention slots 64 located on the outer edges of each of mounting ear 48. Retention frame 36 can thus be secured to mounting ears 48 by sliding stops 60 into retention slots 64 when the snares 26 are moved toward the first end 42 of the snare frame 24. The retention block 34 is secured to the retention plate 44 between flanges 46 by fastener 66 which enables increasing or decreasing tension simultaneously on all of the snares 26 by tightening or loosening fastener 66.

Figure 5:
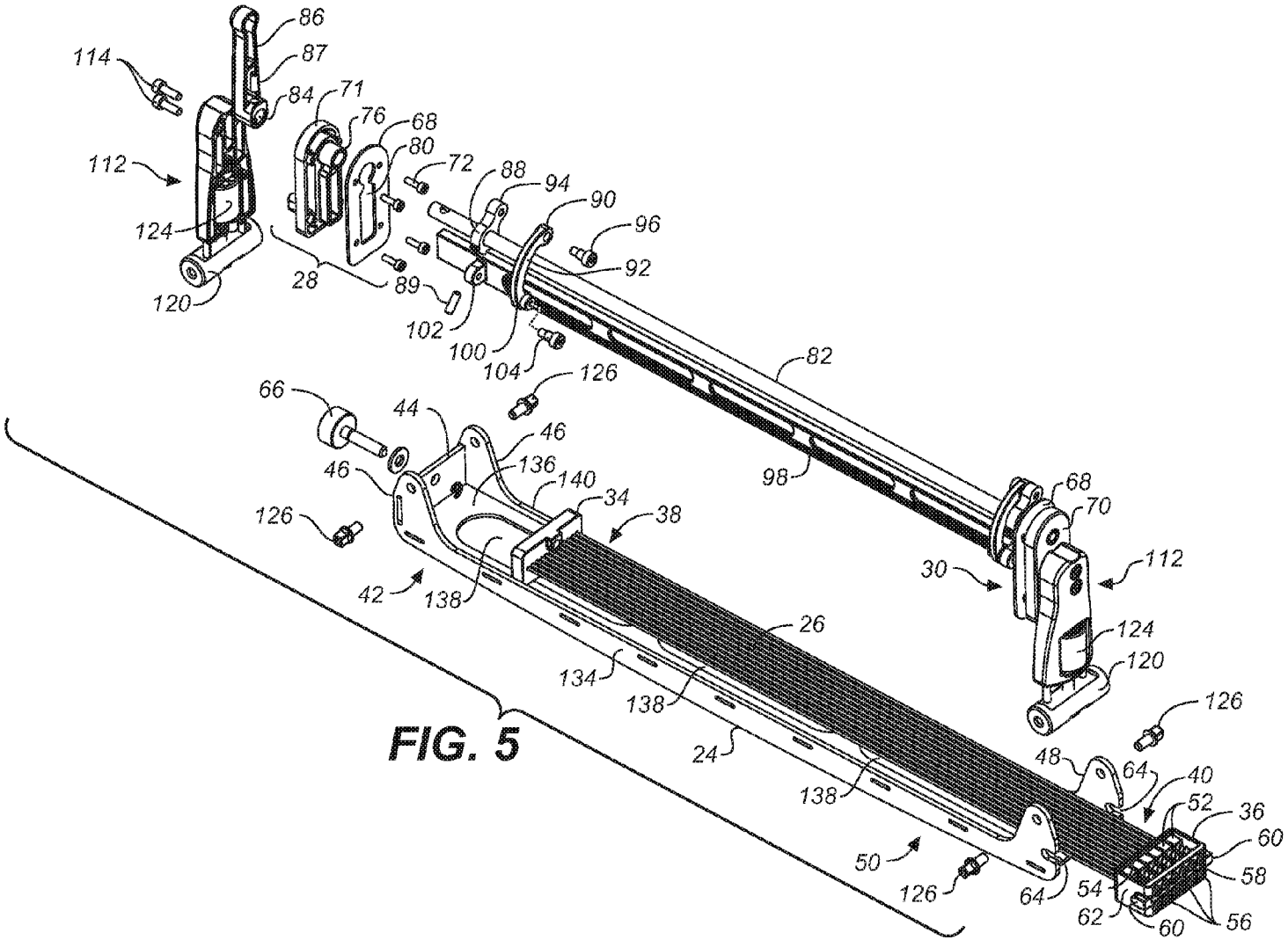
FIG. 5 is an exploded view of the throw-off mechanism, mounting assemblies, snare frame and snares shown in FIGS. 4A and 4B.
Figure 6A:
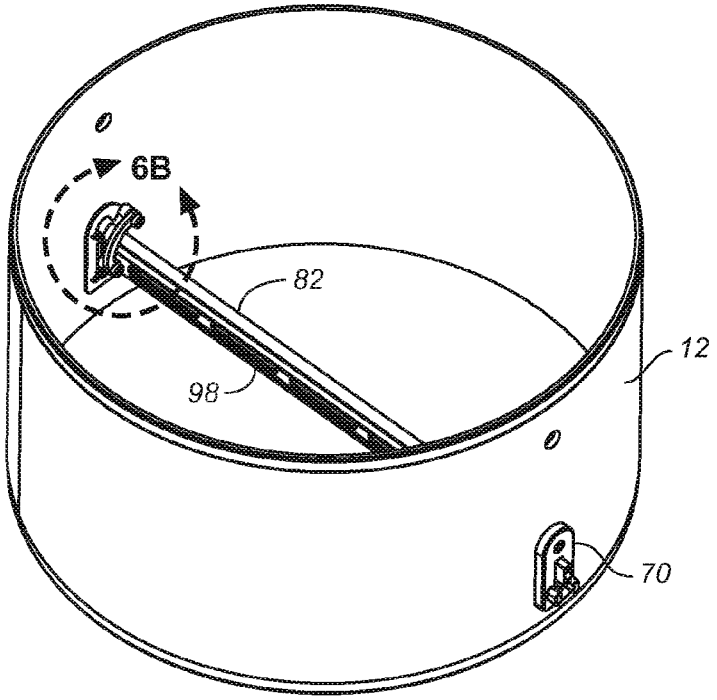
FIG. 6A is a simplified upper perspective view showing the strainer mechanism installed in the shell of a snare drum according to the invention.
Figure 6B:
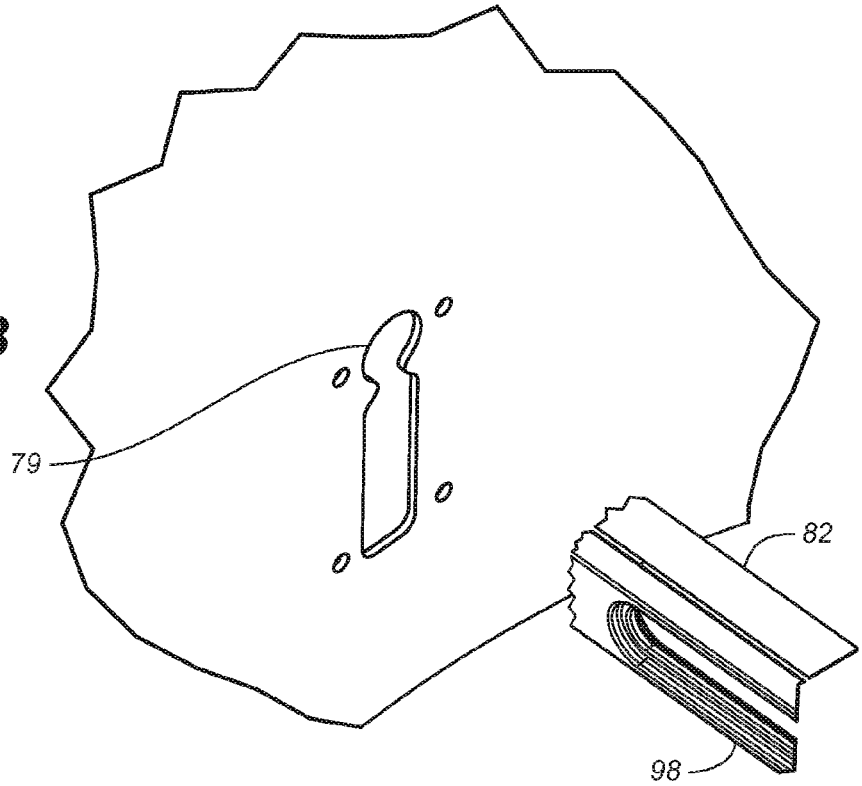
FIG. 6B is a simplified upper perspective view similar to FIG. 6A, but with parts of the strainer mechanism cut away to show the attachment plate openings in the sides of the shell.
Figure 6C:
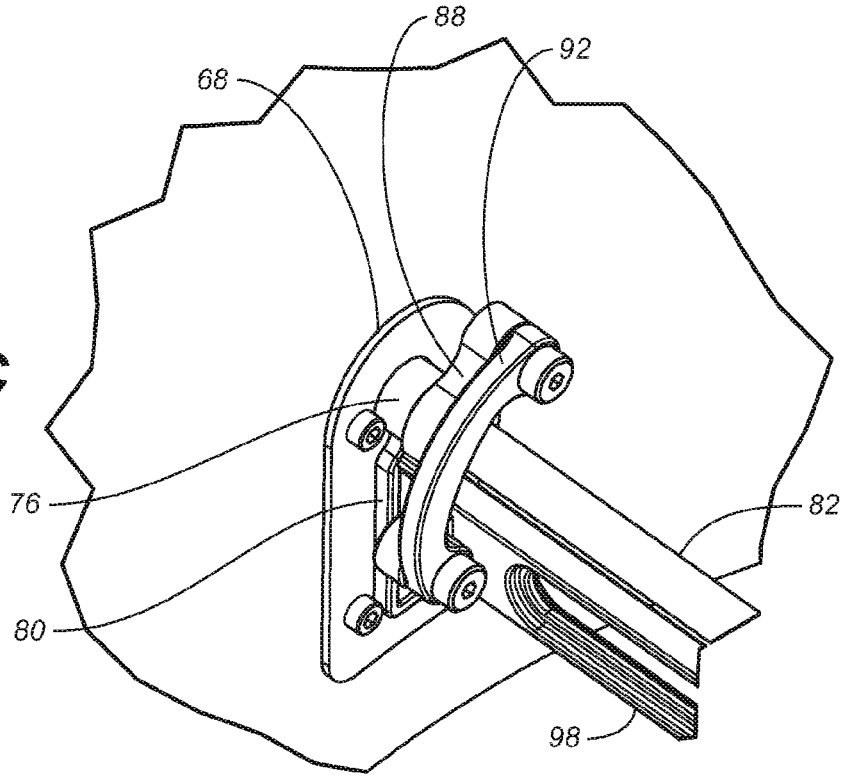
FIG. 6C is a close-up view of a portion of FIG. 6A showing where one end of the strainer and strainer shaft are mounted to the shell.

With continuing reference to FIG. 5, each mounting assembly 28, 30 comprises an inner attachment plate 68 and an outer attachment plate 70, 71. With reference to FIGS. 6A, 6B, 7A, 8 and 9A, it is seen that inner attachment plate 68 is positioned on the inside of shell 12 and secures outer attachment plate 70 to the outside of shell 12 with fasteners 72. A rectangular keeper channel 74 and a bushing 76 extend inwardly from the main body 78 of the outer attachment plate 70 through attachment plate opening 79 in shell 12 and are received in keyhole 80 in inner attachment plate 68.

Figure 7A:
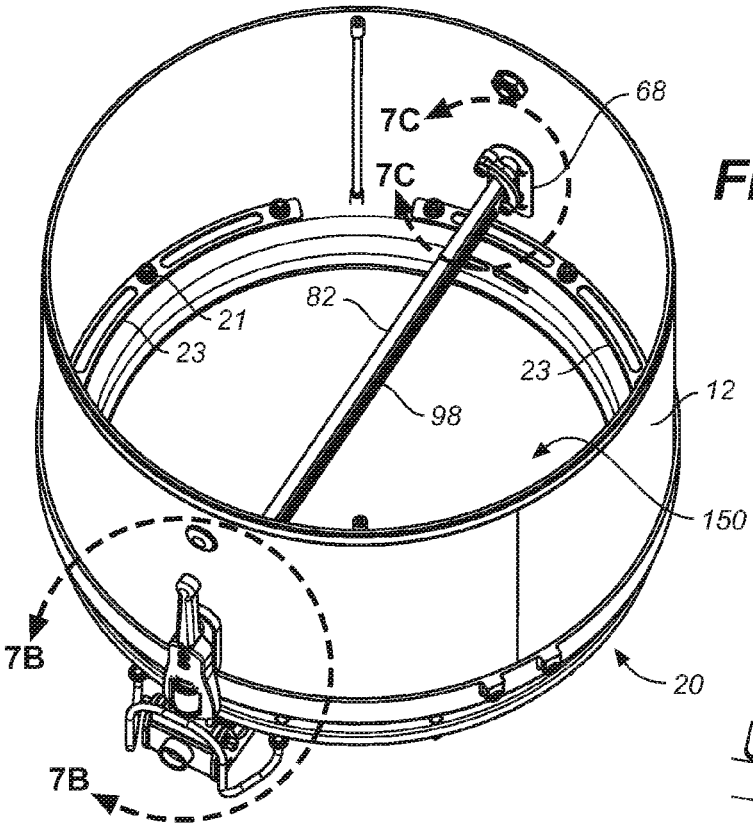
FIG. 7A is a simplified upper perspective view similar to FIG. 6A showing the strainer mechanism installed in the shell of a snare drum from a different angle and also showing the throw-off handle on the outside of the shell.
Figure 7C:
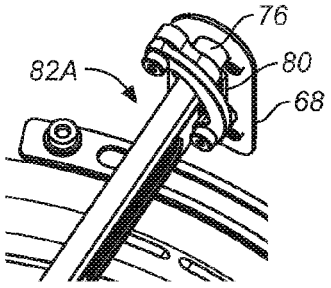
FIG. 7C is a close-up view of a portion of FIG. 7A showing the throw off mechanism where attached to the inside of the shell opposite the handle.
Figure 7B:
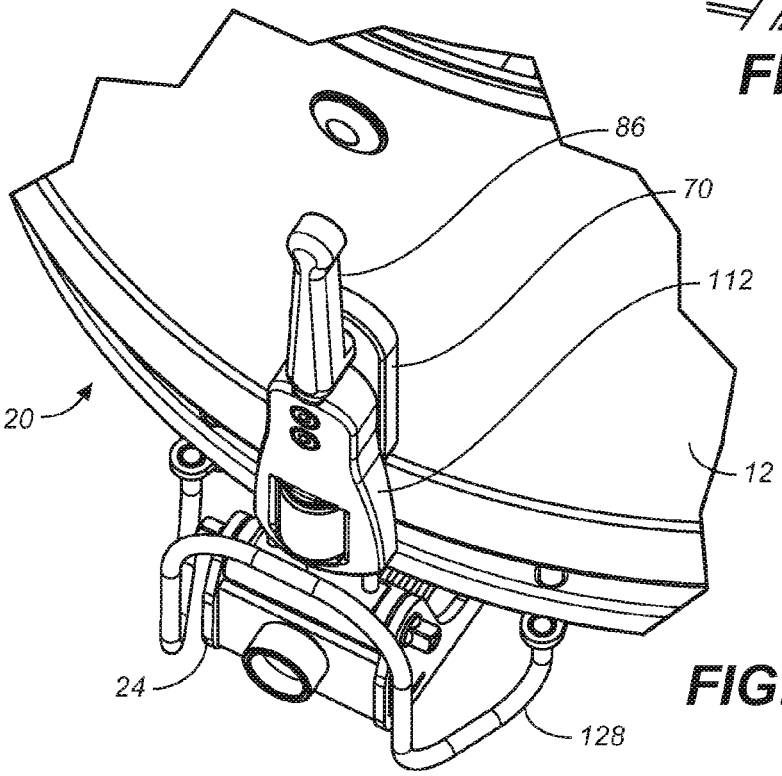
FIG. 7B is a close-up view of a portion of FIG. 7A showing the throw-off handle.
Figure 8:
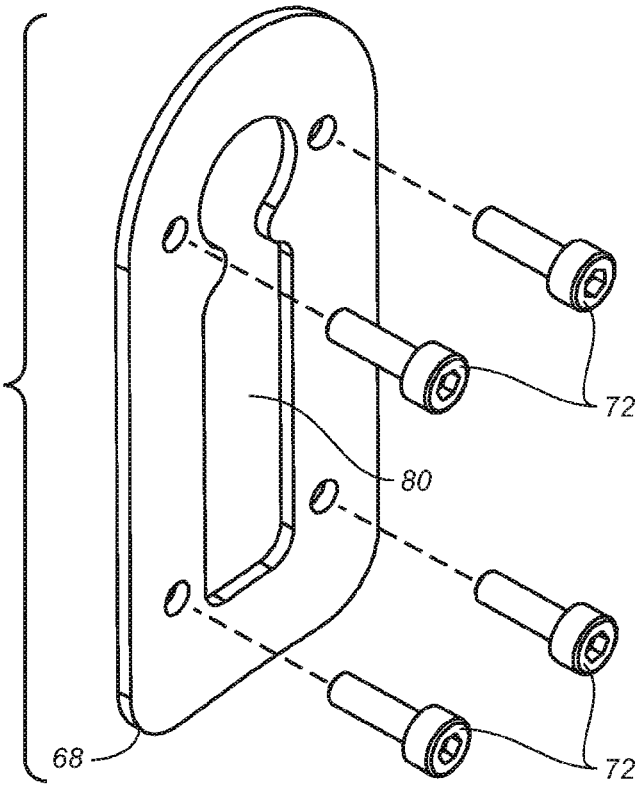
FIG. 8 is an enlarged exploded upper perspective view of the inner attachment plate and fasteners.
Figure 9A:
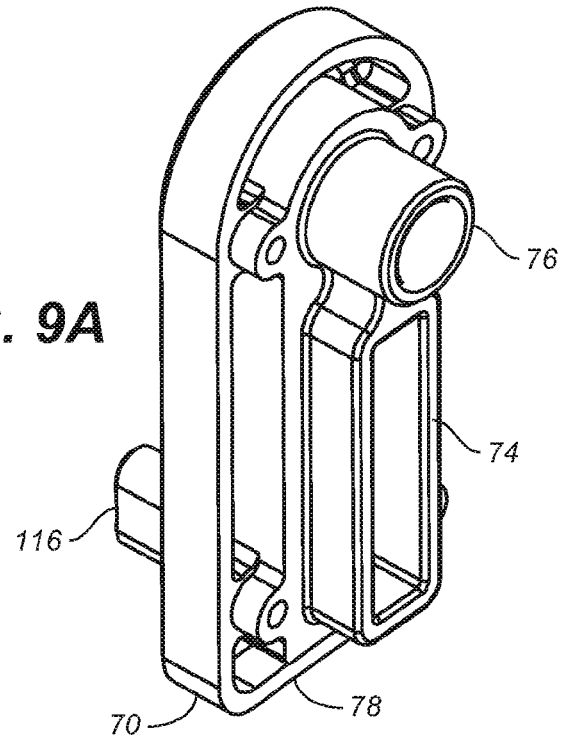
FIG. 9A is an enlarged upper perspective view of the outer attachment plate.
Figure 9B:
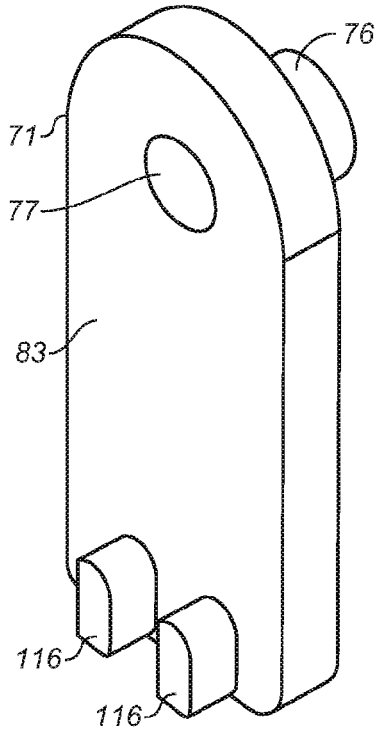
FIG. 9B is an enlarged upper perspective view of the opposite side of the attachment plate shown in FIG. 9A.

As can best be understood with reference to FIGS. 5 and 7C, one end 82A of strainer shaft 82 passes through keyhole 80 in the inner attachment plate 68 and is rotatably received in the bushing 76 of the outer attachment plate 70 of mounting assembly 30. Similarly, with reference to FIGS. 5, 6A, 6B and 10, the other end 82B of strainer shaft 82 passes through keyhole 80 in the inner attachment plate 68 and is rotatably received in the bushing 76 of the outer attachment plate 71 of the other mounting assembly 28. Outer attachment plate 71 is identical to outer attachment plate 70 except that bore 77 formed by bushing 76 opens in outer wall 83 of plate 71 as seen in FIG. 9B. This enables shaft end 82B to extend through bushing 76 into aperture 84 of throw-off handle 86 in which it is secured by tightening fastener 87 in hole 87A. Primary links 88 are attached to strainer shaft 82 by fastener 89 so that rotation of shaft 82 causes links 88 to swivel. The upper ends 90 of secondary links 92 are pivotally attached to extended free ends 94 of primary links 88 by pivot pins 96.

Each end of strainer bar 98 is captured in the keeper channel 74 of the outer attachment plates 70, 71 such that any axial movement is restrained. However, the vertical dimension of keeper channels 74 is greater than the height of strainer bar 98 so that the latter is freely movable vertically in keeper channels 74. The lower ends 100 of secondary links 92 are pivotally attached to pivot bosses 102 fixed to the sides of strainer bar 98 by pivot pins 104.

Figure 12:
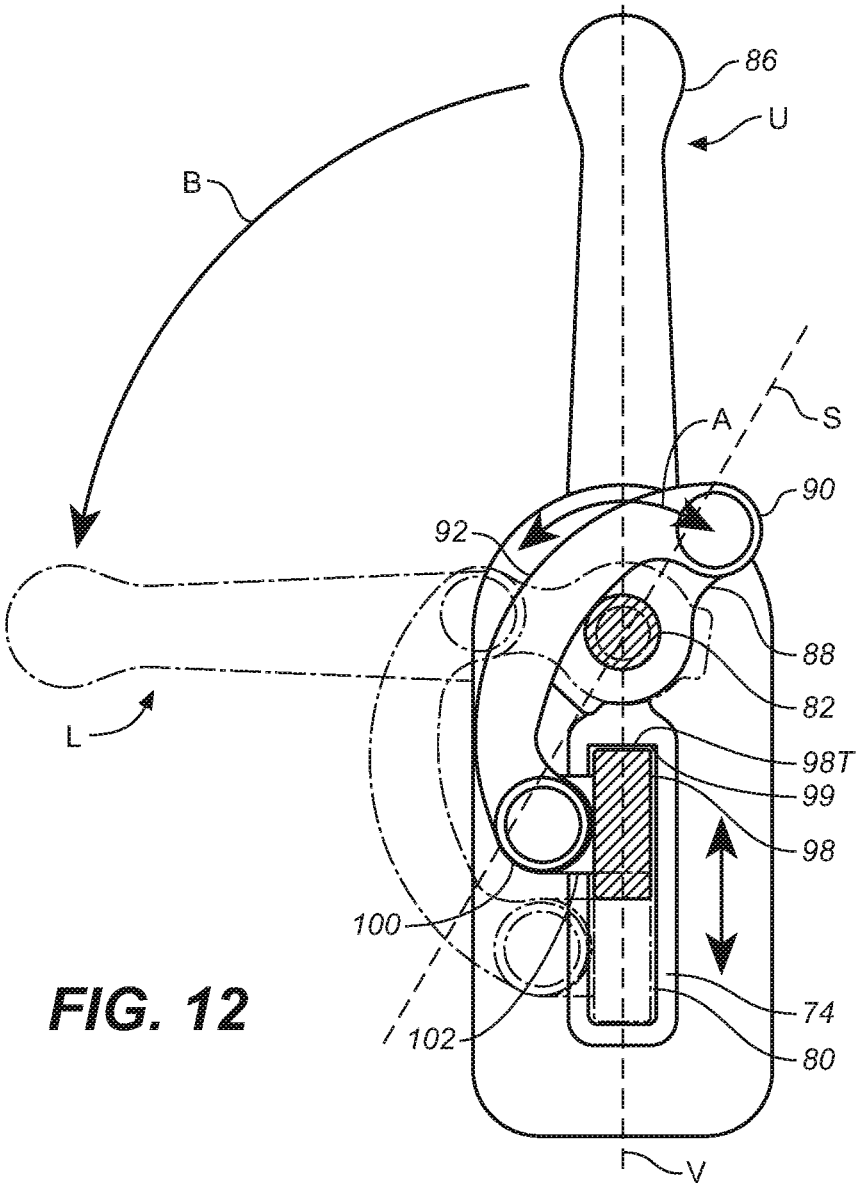
FIG. 12 is a sectional view of the throw off mechanism showing elements thereof in engaged and disengaged configurations.

With reference now to FIG. 12, it is seen that rotation of shaft 82 by manipulation of handle 86 causes primary links 88 to swivel which causes the upper ends 90 of secondary links 92 to swivel through an arc A the vertical component of which causes the lower ends 100 thereof, and hence the strainer 98, to move vertically. Since the primary links 88 are attached to opposite ends of the strainer shaft 82, strainer bar 98 is maintained in parallel relation to lower head 18 throughout the range of such vertical movement.

Figure 10:
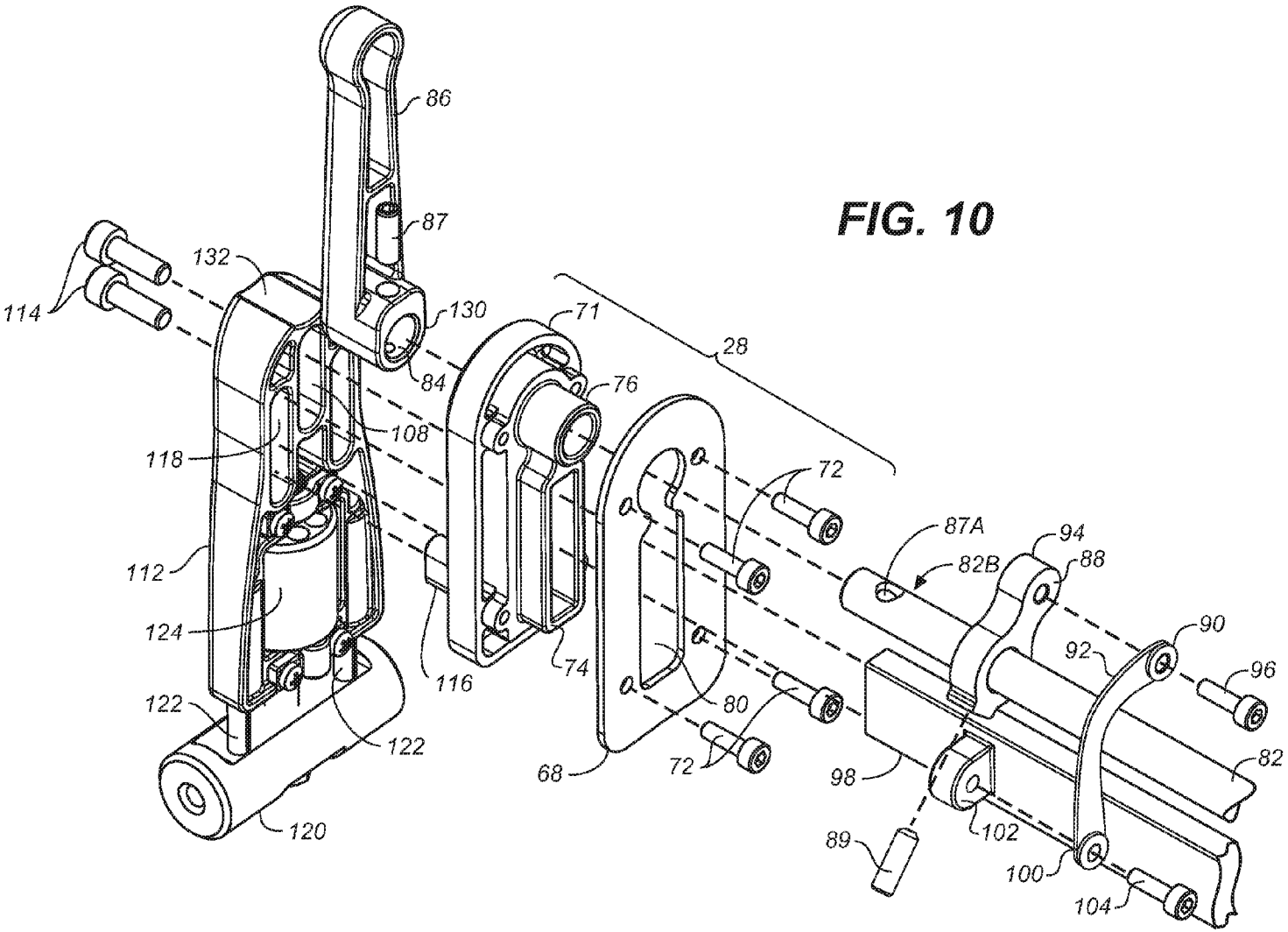
FIG. 10 is an enlarged upper perspective view showing the relationship between the strainer, strainer shaft, inner and outer attachment plates, throw-off handle, and throw off end housings.

Referring now to FIGS. 5, 9B and 10, it is seen that throw off end housings 112 abut the outer walls 83 of each of the outer attachment plates 70, 71. Each end of strainer bar 98 extends through outer attachment plate 70 into inwardly facing rectangular retaining recess 108 in end housing 112 and is affixed therein by fasteners 114. Dual studs 116 extending outwardly from the outer walls 83 of each outer attachment plates 70, 71 are slidingly received in guide slots 118. A barrel nut 120 is connected to the hood 110 of end housings 112 by vertical connection rods 122. The distance which connection rods 122 extend below end housing 112 can be finely adjusted by manipulating adjustment knob 124. Barrel nuts 120 are interposed between flanges 46 on the first end 42 and between mounting ears 48 on the second end 50 of the snare frame 24 and are secured thereto by fasteners 126. The basal portion 130 of handle 86 has a convex surface which mates with the concave curvature of the top 132 of end housing 112.

Figure 11:
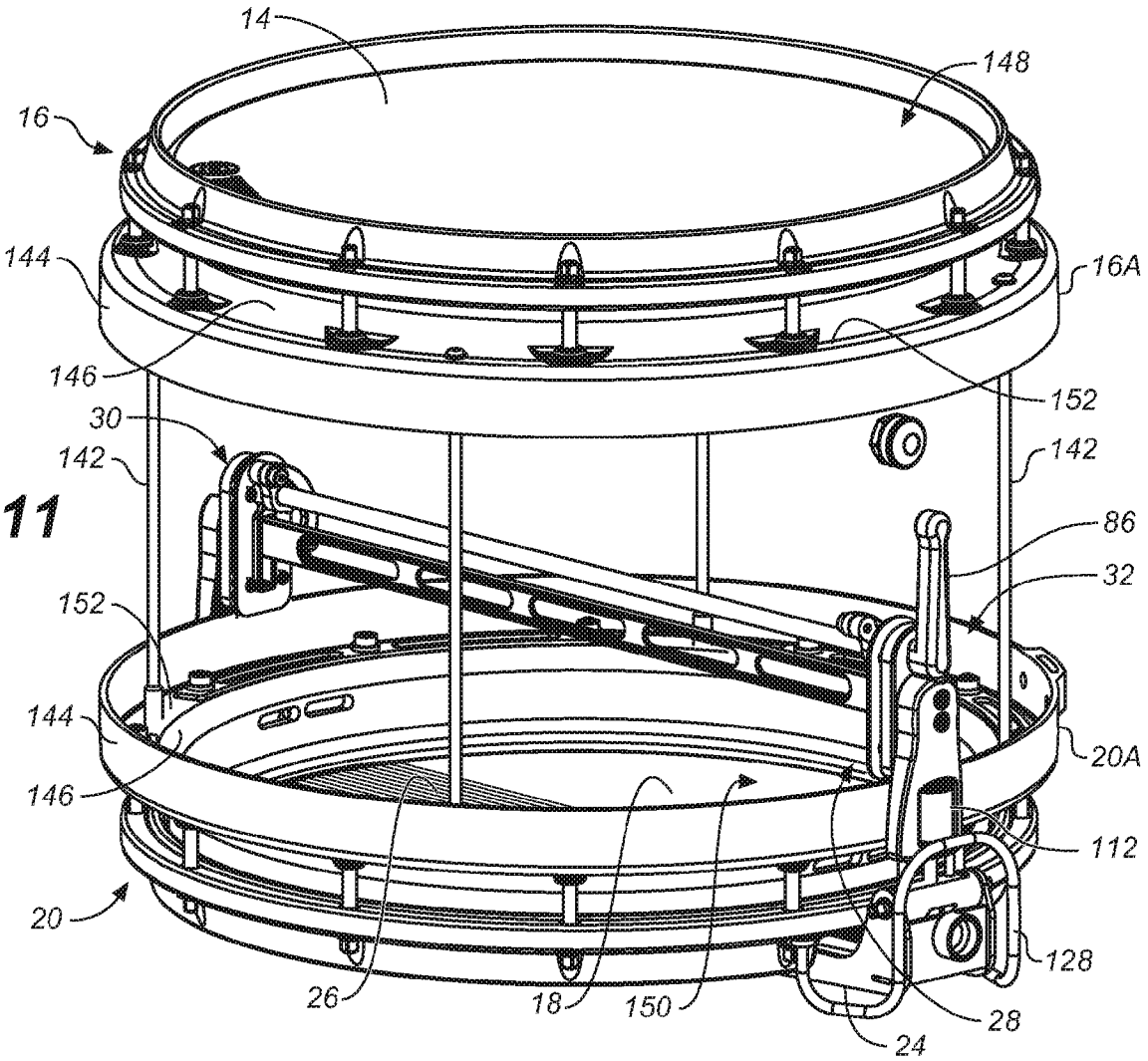
FIG. 11 is an upper perspective view of a snare drum according to the invention wherein the shell has been removed to show the interior workings of the drum.

In FIG. 11, the relationship of snares 26, snare frame 24, mounting assemblies 28, 30 and throw-off mechanism can be seen in relation to the top head 14 and top rim assembly 16 and the bottom head 18 and bottom rim assembly 20. Stands 128 attached to bottom rim assembly 20 allow the snare drum 10 to be placed on a support surface with the snare frame 24 slightly elevated.

In another aspect of the invention, it is seen in FIG. 11 that the shell caps 16A, 20A are connected by internal posts 142.

With additional reference to FIGS. 1-3B, it is seen that this enables the diameter of the shell 12 to be greater than the diameter of the top and bottom drum heads 14, 18 since the mechanisms for retaining the shell between the top and bottom rim assemblies 16, 20 are disposed within the interior of the shell as opposed to prior art tension rod lugs which are mounted on the outer surface of the shell. Each shell cap includes a shell band 144 which wraps around the upper or lower edge of the shell, a head band 146 which forms the top and bottom cap openings 148, 150 for the top and bottom drum heads 14, 18, and a radially extending tension rod plate 152 extending between and connecting the shell band and head band plates. Connecting rods 142 extend between and connect the tension rod plates 152 of the top and bottom shell caps 16A, 20A. Since the shell bands 144 have a diameter larger than the diameter of the head bands 146, the diameter of the shell itself can be larger than the diameter of the head bands. Thus, in the illustrated embodiment, the shell has a larger diameter than the top and bottom heads 14, 18 which allows more air to be moved through the drum and for a unique percussive effect.

Figure 3A:
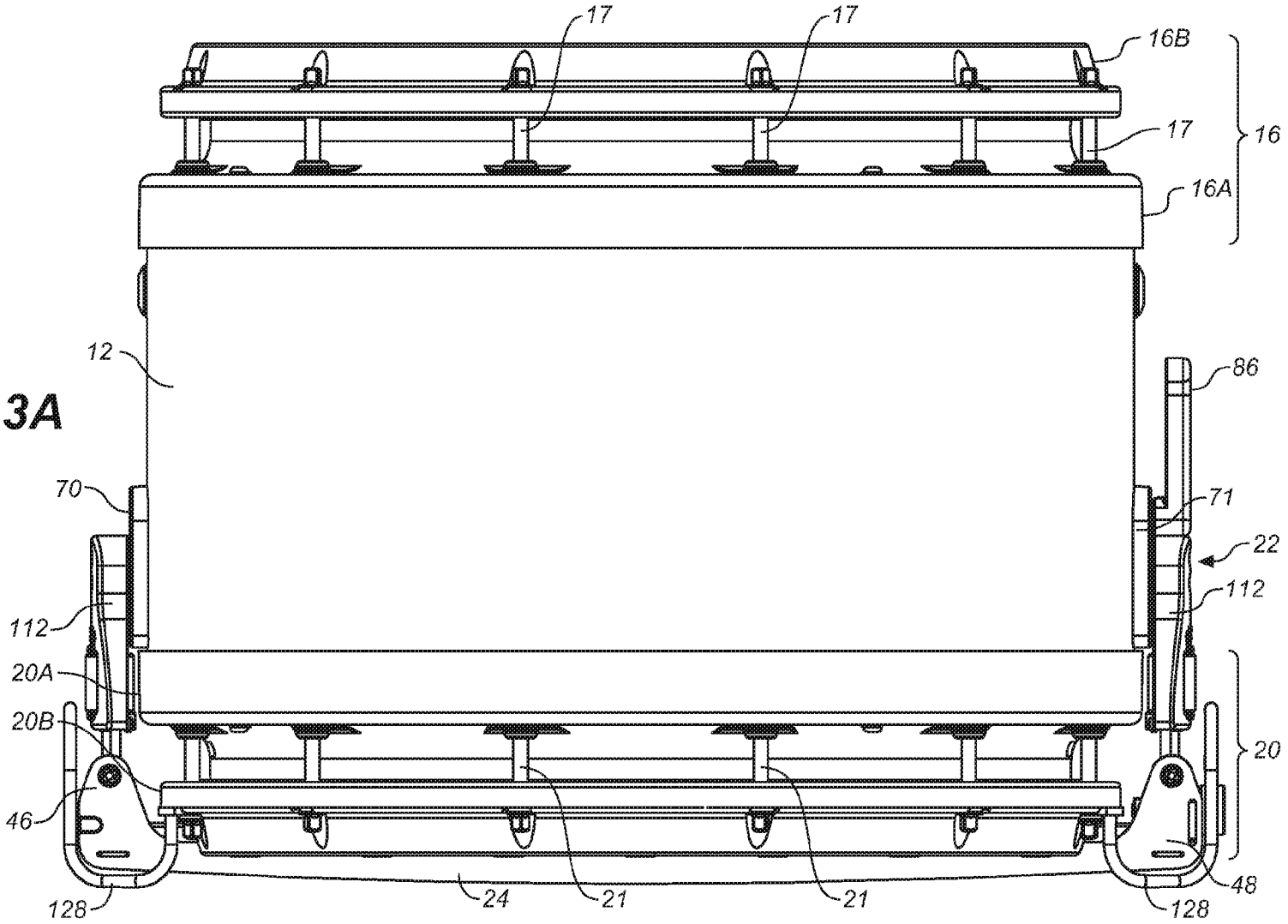
FIG. 3A is a side elevation view thereof showing the snare assembly in an upper position in which the snares are engaged with the bottom head.
Figure 3B:
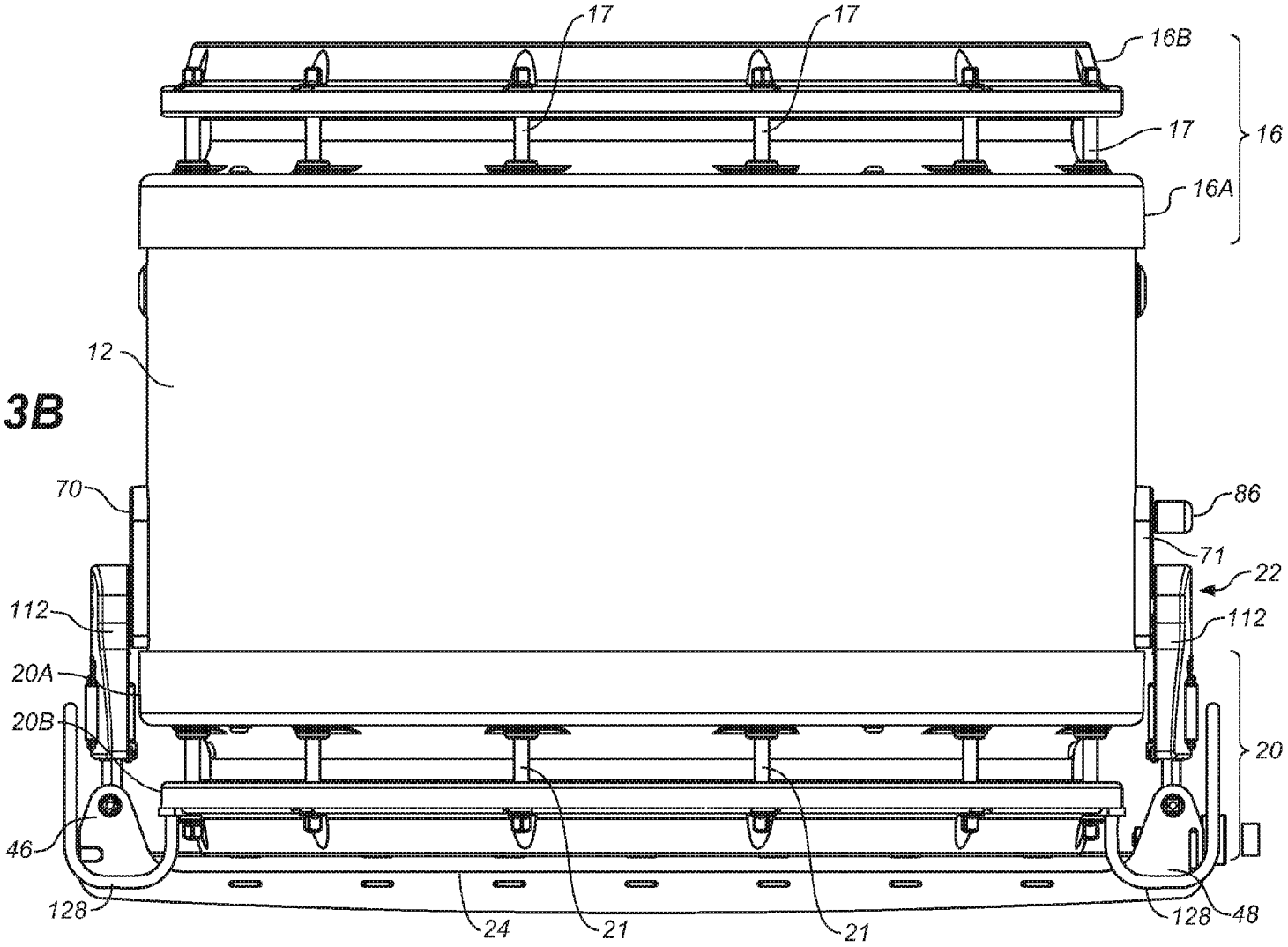
FIG. 3B is a side elevation view similar to FIG. 3A but showing the snare assembly in a lower position in which the snares are disengaged from the bottom head.

As seen in FIGS. 3A, 3B and 12, the snares 26 move vertically between an upper position shown in FIG. 3A, in which they are in direct contact with bottom head 18, and a lower position shown in FIG. 3B, in which they are spaced below bottom head 18, by rotating throw-off handle 86 between an upright position U and a lower position L disposed at an angle of approximately 90° to the upright position as indicated in FIG. 12 by arrow A. Since links 88, 92 are positioned at each end of shaft 82 and strainer bar 98 and work in tandem, strainer bar 98, strainer frame 24 and snares 26 are maintained in parallel disposition to bottom head 18 during such vertical movement.

In the upright position, the free ends 94 of primary links 88 and the upper ends 90 of secondary links 92 are positioned at a slight angle beyond the top of arc A through which they travel during movement between the upper and lower positions U, L. Further rotation of links 88, 92 is prevented by engagement of secondary link 92 with shaft 82 as shown. It will be understood that upward movement of strainer bar 98 is prevented by contact between its top surface 98T and the upper walls 99 of keeper channels 74. This occurs when the free ends 94 of primary links 88 and the upper ends 90 of secondary links 92 are at a slight angle to either side of the top of arc A, such that urging the links over strainer bar 82 and across a strainer bar plane S that is coincident with strainer bar 82 places secondary links 92 under longitudinal stress thereby urging the upper and lower ends 90, 100 thereof together and locking strainer 86 in the upper position. Conversely, the strainer bar 98 can be released from the upper position U to the lowered position L by application of sufficient force on the throw-off handle 86 to move the free ends of 94 links 88 and the upper ends 90 of secondary links 92 back through top arc A and past strainer bar plane S.

Snare frame 24 includes two spaced apart parallel rails 134 extending between flanges 46 and mounting ears 48. A bottom plate 136 extends between rails 134 and includes a plurality of relatively large apertures 138. In the engaged configuration, the top edges 140 of the rails are brought into close adjacency to the bottom head 18 of the snare drum so that the rails 134, bottom plate 136 and apertures 138 form an amplification chamber for amplifying the sounds made by the snares 26 and directing them downwardly through the apertures. The direction and amplification effect is particularly pronounced when the sounds are emitted at soft dynamic levels.

The snare drum 10 has several unique advantages. First, sandwiching a laminated wood shell between carbon-fiber bearing rings significantly reduces the weight of the drum by eliminating the heavy aluminum bearing edges and lug tubes on the sides of the shell used in the prior art. Additionally, the snares 26 can be raised against and lowered away from the bottom head 18 while being maintained in parallel alignment therewith throughout the range of movement between engaged and disengaged positions. This permits the snares to be tuned while disengaged from the bottom head and then to be engaged with the bottom head in tune without losing tension, so that retuning after reengagement of the snare assembly is no longer required.

In addition, the adjustment knobs 124 in each throw off end housing 112 allow fine adjustments of how far the connection rods 122 are extended below the end housing's hood 110 in order to set the distance or degree of tension between the shares 26 and the bottom head 18. Adjustment screws 66 and 56 permit collective and individual adjustment to the tension of the snares 26. The amplification chamber collects, amplifies and directs the sounds produced by the snares 26 instead of allowing them to disperse in all directions.

There have thus been described and illustrated certain embodiments of a snare drum according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

We claim:

1. A snare drum having an improved throw off mechanism, the snare drum having a shell, a bottom opening, an interior space bounded by the shell, and a bottom head secured across the bottom opening, the snare drum comprising:

a strainer shaft extending through the interior space of and rotatably mounted to opposite sides of the shell, a handle disposed on the outside of the shell and attached to one end of the strainer shaft enabling rotation thereof, the handle movable between locking and disengaged positions, a plurality of snare wires linked to the strainer shaft such that movement of the strainer shaft moves the plurality of snare wires, an engaged configuration in which the handle is in the locking position and the plurality of snare wires are engaged with the bottom face of the bottom head, and a disengaged configuration in which the handle is in the disengaged position and the plurality of snare wires are disengaged from the bottom head, wherein, in both the engaged and disengaged configurations the snare wires are disposed parallel to the bottom head.

2. The snare drum of claim 1 further comprising:

the handle having an inwardly facing aperture, wherein one end of the strainer shaft is secured in said aperture.

3. The snare drum of claim 1 further comprising:

first and second mounting assemblies each attached to opposite sides of the shell and each having an inwardly facing keeper channel, and a strainer bar extending through the interior of the shell and having first and second ends each received in the keeper channel of one of the first and second mounting assemblies, said strainer bar linked to the plurality of snare wires, wherein said strainer bar ends are restricted against lateral movement by said keeper channels, but are freely movable vertically in said keeper channels.

4. The snare drum of claim 1 further comprising:

two spaced apart parallel rails each having opposite ends and a top edge, each of the rails for disposition perpendicularly to the bottom head of the snare drum, a pair of attachment flanges extending from the ends of the rails and above the top edge thereof, the plurality of snare wires extending between the attachment flanges parallel to and slightly above the top edges of the rails, and a bottom plate extending between and interconnecting the rails below the snare wires, the bottom plate including a plurality of apertures, the attachment flanges configured for attachment to the throw off mechanism for movement between engaged and disengaged configurations, wherein in the engaged configuration the snare wires are engaged with the bottom head and the top edges of the rails are closely adjacent to the bottom head, and in the disengaged configuration the snare wires are disengaged from the bottom head, such that the rails and the bottom plate form a chamber for amplification and direction of sounds generated by the snare wires through the plurality of apertures of the bottom plate.

5. The snare drum of claim 1 further comprising:

first and second mounting assemblies each attached to opposite sides of the shell, the strainer shaft having first and second ends rotatably received in said first and second mounting assemblies.

6. The snare drum of claim 5 further comprising:

the first and second mounting assemblies each having an inwardly facing keeper channel, and a strainer bar extending through the interior of the shell and having first and second ends each received in the keeper channel of one of the first and second mounting assemblies, said strainer bar linked to the plurality of snare wires and movable between first and second positions, wherein, in the engaged configuration the strainer bar is in the first position, and in the disengaged configuration the strainer bar is in the second position.

7. The snare drum of claim 6 wherein:

the first position of said strainer bar is located above the second position.

8. The snare drum of claim 6 further comprising:

a snare frame having opposite ends, a plurality of snare wires suspended between said opposite ends, a pair of throw off end housings disposed outwardly of said first and second mounting assemblies, each of said pair of throw off end housings having a retaining recess, the first and second ends of said strainer bar extending from the keeper channels of said mounting assemblies and secured in the retaining recesses of said pair of throw off end housings, each of said throw off end housings attached to one end of said snare frame, such that rotation of said handle causes said snare frame to move vertically.

9. The snare drum of claim 8 further comprising:

each of said pair of throw off end housings having a hood, a pair of connection rods, a barrel nut, and an adjustment knob, the hood including an outer face, the pair of connection rods extending an adjustable distance below the hood, the adjustment knob rotatably secured in the hood and exposed in said outer face for manipulation thereof, the barrel nut suspended from the pair of connection rods and affixed to one of the ends of the snare frame, the adjustment knob operatively attached to the pair of connection rods such that rotation thereof adjusts the distance that the connection rods extend below the hood.

10. The snare drum of claim 6 further comprising:

a plurality of primary links attached to the first and second ends of said strainer shaft, said primary links disposed in the interior of the shell, and a plurality of secondary links pivotally attached to said strainer bar, each of said plurality of secondary links pivotally attached to one of said plurality of primary links, said strainer bar moveable between said first and second positions by rotation of said strainer shaft.

11. The snare drum of claim 10 wherein:

the shell includes two oppositely disposed attachment plate openings, and each of said first and second mounting assemblies further comprises an inner attachment plate positioned inside the shell, an outer attachment plate positioned outside the shell, and a bushing, the outer attachment plate fastened to the inner attachment plate, the inner attachment plate having a keyhole opening, the bushing and the keeper channel of each of said mounting assemblies extending inwardly from the outer attachment plate thereof through one of the attachment plate openings and through the keyhole opening of the inner attachment plate thereof.

12. The snare drum of claim 11 wherein:

said strainer bar includes a plurality of pivot bosses, each of said plurality of primary links extends radially away from the strainer shaft and includes a free end, rotation of the strainer shaft moving the free end of each of said plurality of primary links through an arc about the strainer shaft, and each of said secondary links has an upper end and a lower end, the upper end being pivotally attached to the free end of one of the plurality of primary links, the lower end being pivotally attached to one of the plurality of pivot bosses, in said engaged configuration, the free end of each of said plurality of primary links is disposed above said strainer shaft, and in said disengaged configuration, the free end of each of said plurality of primary links is disposed below its position in said engaged configuration.

13. The snare drum of claim 12 further comprising:

a vertical plane bisecting said strainer shaft and said strainer bar, a strainer bar plane bisecting said strainer shaft, said first position of said strainer bar disposed above said second position, said strainer bar restricted against moving upward from said first position by the keeper channels of said mounting assemblies, each of the plurality of secondary links having an arced link body extending between the upper and lower ends thereof, wherein, in said engaged configuration, the free end of each said plurality of primary links is offset from said vertical plane, the link body of each of said plurality of secondary links is abutting the strainer shaft on one side of said strainer bar plane, the upper and lower ends of each of said plurality of secondary links are disposed on the other side of said strainer bar plane and are under longitudinal tension such that they are biased toward each other, thereby urging said link body against said strainer shaft to lock said links in said engaged configuration.

14. The snare drum of claim 1 further comprising:

the shell having a bottom edge bounding the bottom opening, a bottom shell cap attached to said bottom edge, said bottom shell cap having a circumferentially distributed array of bottom tension rods, said bottom shell cap forming a bottom cap opening, a bottom head positioned over said bottom shell cap across said bottom cap opening, said bottom head having a peripheral area extending radially outward from said bottom cap opening, and a bottom rim disposed across the peripheral area of said bottom head and adjustably secured to said bottom shell cap by said array of bottom tension rods.

15. The snare drum of claim 14 further comprising:

the shell having a top edge forming a top opening, a top shell cap attached to said top edge, said top shell cap having a circumferentially distributed array of top tension rods, said top shell cap forming a top cap opening, a top head positioned over said top shell cap across said top cap opening, said top head having a peripheral area extending radially outward from said top cap opening, and a top rim disposed over the peripheral area of said top head and adjustably secured to said top shell cap by said array of tension rods.

16. The snare drum of claim 15 wherein:

the shell comprises wood and the top and bottom shell caps comprise carbon fiber.

17. The snare drum of claim 15 wherein:

each of said top and bottom shell caps includes an axially extending shell band, an axially extending head band, and a radially extending annular tension rod plate connecting the shell and head bands, the shell band of each of the top and bottom shell caps wrapping around one of the top and bottom edges of the shell and having a diameter greater than that of the head band, and the shell has a greater diameter than each of the top and bottom heads.

18. The snare drum of claim 17 further comprising:

a plurality of posts extending between and interconnecting the tension rod plates of each of the top and bottom shell caps, the plurality of posts disposed in the interior of the shell.

19. A snare drum having an improved throw off mechanism, the snare drum including a shell forming a bottom opening, an interior space laterally bounded by the shell, and a bottom head secured across the bottom opening, the snare drum comprising:

first and second mounting assemblies each having an inwardly-facing keeper channel, the first and second mounting assemblies attached to opposite sides of the shell, a strainer shaft extending through the interior space of the shell, the strainer shaft having first and second ends rotatably received in the mounting assemblies, a handle disposed on the outside of the shell and attached to one end of the strainer shaft enabling rotation thereof, the handle movable between locking and disengaged positions, a strainer bar and having first and second ends and a plurality of pivot bosses, each of the ends of the strainer bar received in the keeper channel of one of the mounting assemblies, the strainer bar extending through the interior of the shell and moveable between first and second positions, a plurality of primary links disposed in the interior space of the shell and attached to the first and second ends of the strainer shaft, each of the plurality of primary links extending radially away from the strainer shaft, a plurality of secondary links each having an upper end and a lower end, the upper end being pivotally attached to the free end of one of the plurality of primary links, the lower end being pivotally attached to one of the plurality of pivot bosses, a plurality of snare wires connected to the strainer shaft such that movement of the strainer shaft moves the plurality of snare wires, an engaged configuration in which the handle is in the locking position, the free end of each of the plurality of primary links is above the strainer shaft, the strainer bar is in the first position, and the plurality of snare wires are engaged with the bottom head, and a disengaged configuration in which the handle is in the disengaged position, the free end of each of said plurality of primary links is disposed below its position in said engaged configuration, the strainer bar is in the second position, and the plurality of snare wires are disengaged from the bottom head, wherein, in both the engaged and disengaged configurations the snare wires are disposed parallel to the bottom head.

20. A snare drum having an improved throw off mechanism, the snare drum having a shell forming a bottom opening, an interior space laterally bounded by the shell, and a bottom head secured across the bottom opening, the snare drum comprising:

first and second mounting assemblies each attached to opposite sides of the shell, the first and second mounting assemblies each having an inwardly facing bushing and an inwardly facing keeper channel, a strainer shaft extending through the interior of the shell, the strainer shaft having first and second ends rotatably received in the bushings of said first and second mounting assemblies, a handle having an inwardly facing aperture, the first end of said strainer shaft extending from the first mounting assembly and secured in the aperture of said handle, such that rotation of the handle rotates the strainer shaft, the handle movable between locking and disengaged positions, a strainer bar extending through the interior of the shell and having first and second ends each received in the keeper channel of one of said first and second mounting assemblies, said strainer bar being movable between first and second positions, a plurality of primary links attached to the first and second ends of said strainer shaft, said primary links disposed in the interior of the shell, a plurality of secondary links pivotally attached to said strainer bar, each of said plurality of secondary links pivotally attached to one of said plurality of primary links, said strainer bar moveable between first and second positions by rotation of said strainer shaft, a plurality of snare wires connected to said strainer bar, and engaged and disengaged configurations, in said engaged configuration said handle is in said locking position, said strainer bar is in said first position and said snare wires are engaged with the bottom head, in said disengaged configuration said handle is in said disengaged position, said strainer bar is in said second position and said snare wires are vertically spaced from the bottom head, in each of said engaged and disengaged positions said plurality of snare wires are disposed parallel to the bottom head.

21. A snare frame for a snare drum, the snare drum having a bottom head and a throw off mechanism, the snare frame comprising:

two spaced apart parallel rails each having opposite ends and a top edge, each of the rails for disposition perpendicularly to the bottom head of the snare drum, a pair of attachment flanges extending from the ends of the rails and above the top edge thereof, a plurality of snare wires extending between the attachment flanges parallel to and slightly above the top edges of the rails, a bottom plate extending between and interconnecting the rails below the snare wires, the bottom plate including a plurality of apertures, the attachment flanges configured for attachment to the throw off mechanism for movement between engaged and disengaged configurations, wherein in the engaged configuration the snare wires are engaged with the bottom head and the top edges of the rails are closely adjacent to the bottom head, and in the disengaged configuration the snare wires are disengaged from the bottom head, such that the rails and the bottom plate form a chamber for amplification and direction of sounds generated by the snare wires through the plurality of apertures of the bottom plate.

22. A snare drum having an improved throw off mechanism, the snare drum having a shell, a bottom opening, an interior space bounded by the shell, and a bottom head secured across the bottom opening, the snare drum comprising:

first and second mounting assemblies each attached to opposite sides of the shell and each having an inwardly facing keeper channel, a strainer shaft extending through the interior space of the shell and having first and second ends rotatably received in said first and second mounting assemblies, a handle disposed on the outside of the shell and attached to one end of the strainer shaft enabling rotation thereof, the handle movable between locking and disengaged positions, a plurality of snare wires linked to the strainer shaft such that movement of the strainer shaft moves the plurality of snare wires, a strainer bar extending through the interior of the shell and having first and second ends each received in the keeper channel of one of the first and second mounting assemblies, said strainer bar linked to the plurality of snare wires and movable between first and second positions, an engaged configuration in which the handle is in the locking position, the strainer bar is in the first position and the plurality of snare wires are engaged with the bottom head, and a disengaged configuration in which the handle is in the disengaged position, the strainer bar is in the second position and the plurality of snare wires are disengaged from the bottom head, wherein, in both the engaged and disengaged configurations the snare wires are disposed parallel to the bottom head.

* * * * *